US011727903B2

(12) United States Patent
Carr

(10) Patent No.: US 11,727,903 B2
(45) Date of Patent: Aug. 15, 2023

(54) PORTABLE, MUSICAL INSTRUMENT CLAMP AND METHODS OF MAKING AND USING SAME

(71) Applicant: Rian Carr, Easton, PA (US)

(72) Inventor: Rian Carr, Easton, PA (US)

( * ) Notice: Subject to any disclaimer, the term of this patent is extended or adjusted under 35 U.S.C. 154(b) by 166 days.

(21) Appl. No.: 17/514,435

(22) Filed: Oct. 29, 2021

(65) Prior Publication Data

US 2022/0208154 A1 Jun. 30, 2022

Related U.S. Application Data

(63) Continuation-in-part of application No. 63/130,437, filed on Dec. 24, 2020.

(51) Int. Cl.
*G10D 3/00* (2020.01)
*G10G 5/00* (2006.01)

(52) U.S. Cl.
CPC ..... *G10G 5/00* (2013.01)

(58) Field of Classification Search
CPC ..... G10G 5/00; G10D 1/05; A47F 7/00
See application file for complete search history.

(56) References Cited

U.S. PATENT DOCUMENTS 6,481,677 B1 * 11/2002 Yu ..... A47F 5/083 84/327
2012/0074270 A1 * 3/2012 Pays ..... G10D 3/22 248/121

* cited by examiner

*Primary Examiner* — Kimberly R Lockett
(74) *Attorney, Agent, or Firm* — James R. McDaniel

(57) ABSTRACT

A musical instrument clamp system which includes a bracket assembly having a first end and a second end, a cradle assembly, a clamp assembly operatively connected to the first end of the bracket assembly, wherein the clamp assembly is also removably attached to the cradle assembly, an extension assembly having a first end and a second end, wherein the first end of the extension assembly is operatively connected to the second end of the bracket assembly, a hook assembly, wherein the hook assembly is operatively connected to the second end of the extension assembly, and a musical instrument removably retained on the hook assembly.

20 Claims, 8 Drawing Sheets

PORTABLE, MUSICAL INSTRUMENT CLAMP AND METHODS OF MAKING AND USING SAME

CROSS-REFERENCE TO RELATED APPLICATION

This application is a continuation-in-part of U.S. Patent Application 63/130,437, filed on Dec. 24, 2020, the disclosure of which is hereby incorporated by reference in its entirety to provide continuity of disclosure to the extent such a disclosure is not inconsistent with the disclosure herein.

FIELD OF THE INVENTION

The present invention is generally related to a portable, musical instrument clamp that is capable of holding a musical instrument while the instrument is not being played and also includes an opening in the clamp bracket that allows a universal musical instrument tool used for repairing and working on musical instruments such as necked/stringed musical instruments to be removably retained within the clamp opening. The portable, musical clamp can be easily attached to and removed from a variety of secure locations such as a cradle assembly, chair backs, tables, countertops, book shelves, railings or the like. Finally, the portable, musical clamp is capable of holding a variety of musical instruments.

BACKGROUND OF THE INVENTION

Prior to the present invention, as set forth in general terms above and more specifically below, it is known, to use a variety of instrument stands and instrument holders/hangers in order to hold a musical instrument that is not currently being played. Typically, the instrument stand sits on the floor and the musical instrument rests on the instrument stand. Also, the musical instrument holders/hangers may be secured to a wall (or other similar rigid surface) through the use of screws located on the holder/hanger so that the musical instrument can hang from the wall when not being used. However, neither the current musical instrument stands or musical instrument holders/hangers are designed to be portable or small enough so that they can fit in the instrument case or designed to attach to a variety of surfaces. Also, the current musical instrument stands and musical instrument holders/hangers are not capable of holding a universal musical instrument tool that can be used for repairing and working on musical instruments such as necked/stringed musical instruments within an opening of the clamp. Finally, the current musical instrument stands and musical instrument holders/hangers are not capable of holding a variety of musical instruments.

It is a purpose of this invention to fulfill these and other needs in the musical instrument holder/hanger art in a manner more apparent to the skilled artisan once given the following disclosure.

The preferred portable, musical instrument clamp, according to various embodiments of the present invention, offers the following advantages: ease of use; portability; the ability to securely retain a musical instrument; the ability to be stored in the musical instrument carrying case; the ability to retain a variety of musical instruments; the ability to be securely attached to a variety of rigid surfaces; lightness in weight; reduced cost; the ability to retain a musical instrument pick; and the ability retain a universal musical instrument tool to be used for repairing and working on the musical instruments. In fact, in many of the preferred embodiments, these advantages are optimized to an extent that is considerably higher than heretofore achieved in prior, known musical instrument stands and musical instrument holders/hangers.

BRIEF DESCRIPTION OF THE DRAWINGS

The above-mentioned features and steps of the invention and the manner of attaining them will become apparent, and the invention itself will be best understood by reference to the following description of the embodiments of the invention in conjunction with the accompanying drawings, wherein like characters represent like parts throughout the several views and in which.

DETAILED DESCRIPTION OF THE PREFERRED EMBODIMENTS OF THE INVENTION

In order to address the shortcomings of the prior, known musical instrument stands and wall-mounted musical instrument holders/hangers, it would be desirable to utilize a portable, musical instrument clamp that is capable of holding a musical instrument while the instrument is not being played and also includes an opening in the clamp bracket that allows a universal musical instrument tool used for repairing and working on musical instruments such as necked/stringed musical instruments or a musical instrument pick to be removably retained within the clamp opening. Also, the portable, musical clamp should be constructed so that it can be easily attached to and removed from a variety of secure locations such as a cradle assembly, chair backs, tables, countertops, book shelves, doors, railings or the like. Finally, the portable, musical clamp should be capable of holding a variety of musical instruments.

Figure 1:
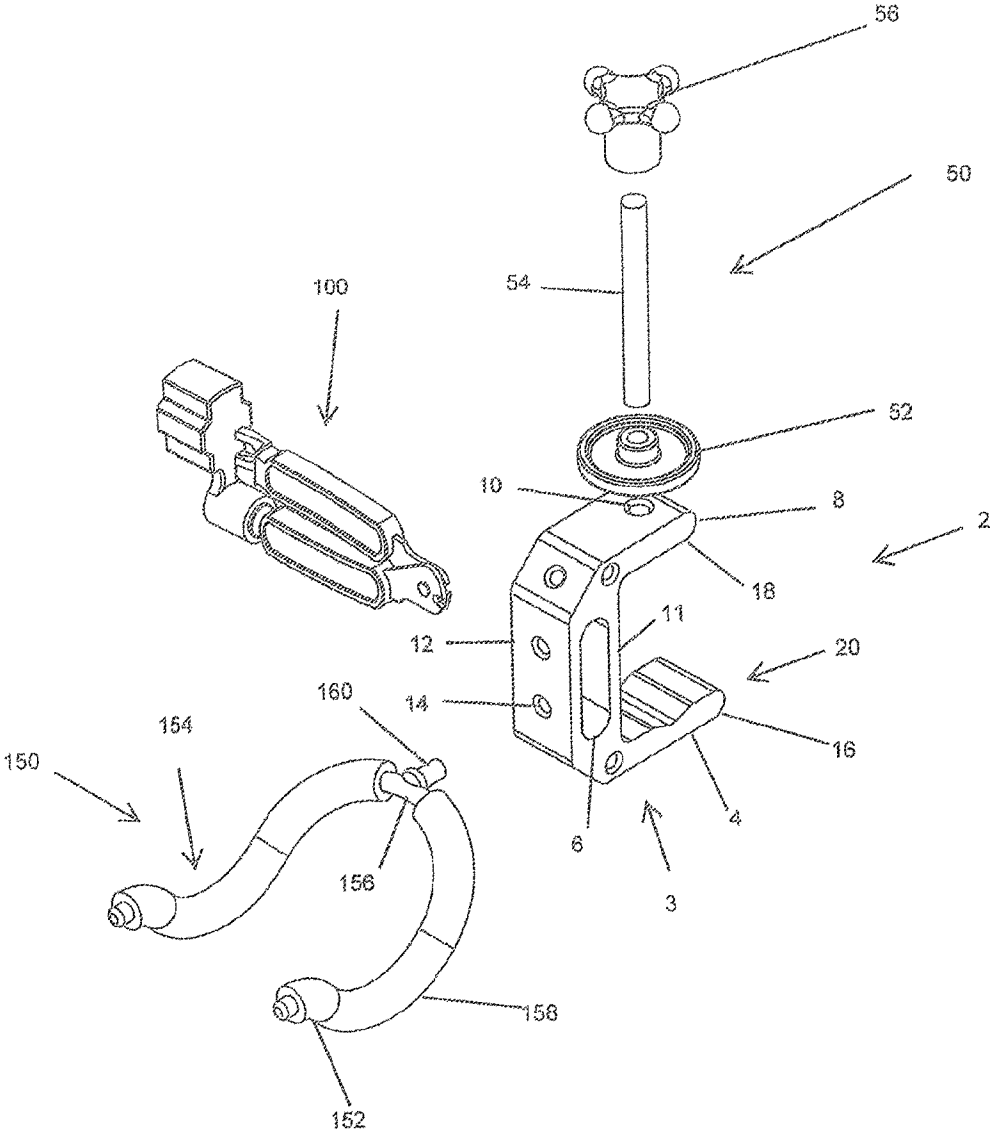
FIG. 1 is a schematic, isometric, exploded view of a portable, musical instrument clamp, constructed according the present invention.
Figure 2:
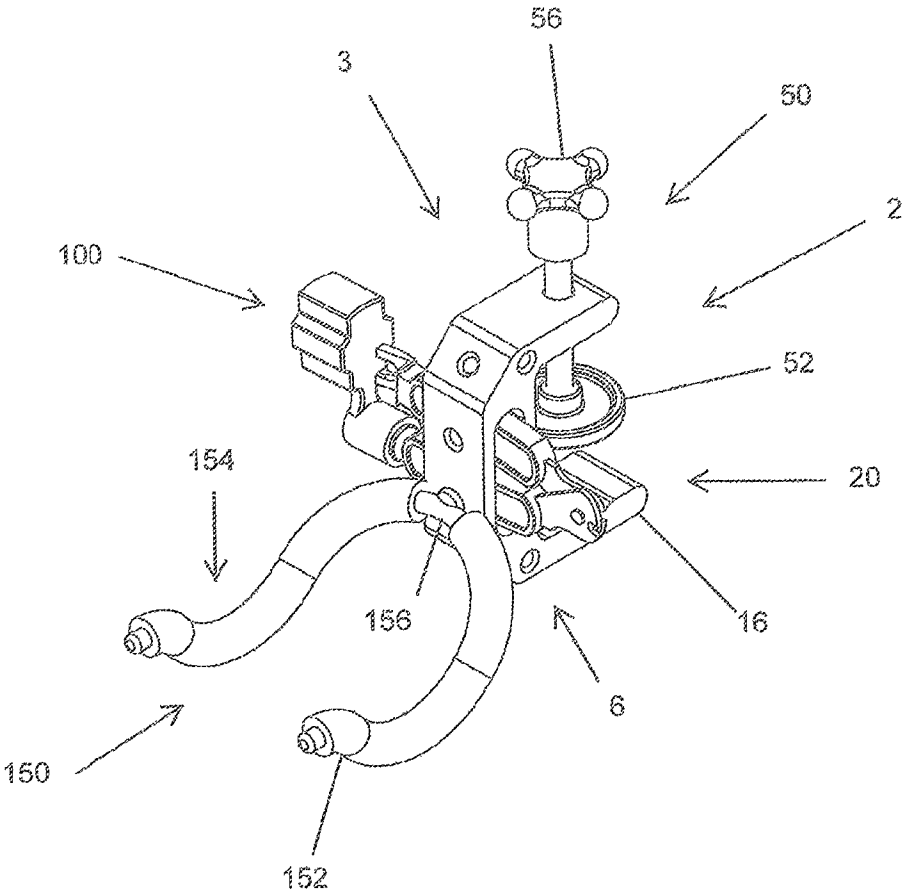
FIG. 2 is a schematic, isometric view of the portable, musical instrument clamp, constructed according the present invention.
Figure 3:
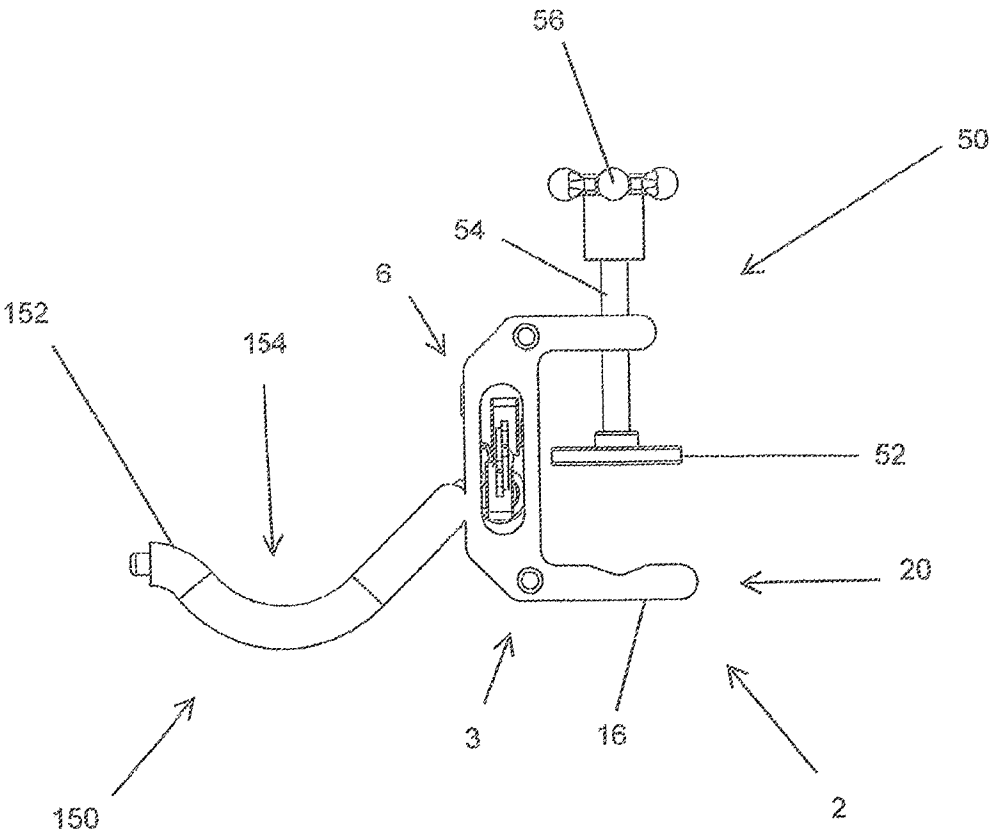
FIG. 3 is a side view of the portable, musical instrument clamp, constructed according the present invention.

Reference is made now to FIGS. 1-3, where there are illustrated portable, musical instrument clamp 2. Portable, musical instrument clamp 2 includes, in part, bracket assembly 3, clamp assembly 50, universal musical instrument tool 100, and hook assembly 150.

Bracket Assembly

With respect to bracket assembly 3, preferably, bracket assembly 3 includes, in part, bracket face 4, bracket opening 6, bracket face 8 having bracket opening 10, bracket base 11, bracket face 12 having bracket opening 14, bracket extension 16, bracket extension 18, and bracket ridge 20. Preferably, bracket base 11, bracket extension 16, and bracket extension 18 are formed as one single piece by conventional forming techniques such as molding, casting, pressing, printing, or the like. Also, bracket base 11, bracket extension 16, and bracket extension 18 are, preferably, constructed of any suitable, durable, high strength, light weight, rust resistant, UV resistant, rigid material.

It is to be understood that bracket face 4 is to be located along a side of bracket extension 16. Also, bracket face 12 is to be located along a side of bracket base 11. Finally, bracket face 8 is to be located along a side of bracket extension 18.

With respect to bracket opening 6, bracket opening 6, preferably, is formed along bracket base 11 as part of the construction of the single piece construction of bracket base 11, bracket extension 16, and bracket extension 18, as previously described. It is to be understood that an important aspect of bracket opening 6 is that the bracket opening should be sized and shaped so as to securely retain universal musical instrument tool 100, as will be described in greater detail later.

Regarding bracket opening 10 and bracket opening 14, bracket opening 10 and bracket opening 14 are preferably formed in bracket face 8 and bracket face 12, respectively, by conventional opening forming techniques such as drilling, threading, boring, punching or the like. It is to be understood that an important aspect of bracket opening 10 and bracket opening 14 is that these openings should be sized and shaped so as to properly retain clamp assembly 50 and hook assembly 150 (FIG. 2), respectively, as will be described in greater detail later. It is to be understood that the size of openings 10 should be different than the size of openings 14.

With respect to bracket ridge 20, bracket ridge 20 is conventionally formed along one end of bracket extension 16 by conventional forming techniques such as milling, welding, casting, printing, or the like. It is to be understood that an important aspect of the bracket ridge 20 is that it should be sized and shaped to as to be able to interact with clamp assembly 50 in order to securely retain portable, musical instrument clamp 2 on a rigid surface such as a chair back, a table, a countertop, a book shelf, a railing or the like (not shown), as will be discussed in greater detail later.

Clamp Assembly

Regarding clamp assembly 50, clamp assembly 50 includes, in part, foot 52, screw 54, and handle 56. Preferably, foot 52, screw 54, and handle 56 are constructed of any suitable, durable, high strength, light weight, rust resistant, UV resistant, rigid material.

It is to be understood that during the construction of clamp assembly 50, screw 54 is conventionally threaded through opening 10. It is to be further understood that opening 10 includes conventional threads (not shown) that will interact with screw 54. Foot 52 is conventionally attached onto one end of screw 54 (FIGS. 2 and 3). Handle 56 is then conventionally attached to the other end of screw 54 (FIGS. 2 and 3).

As will be discussed in greater detail later, in order to secure portable, musical instrument clamp 2 onto a rigid surface such as a chair back, a table, a countertop, a book shelf, a railing or the like (not shown), the user locates portable, musical instrument clamp 2 so that clamp assembly 50 is located adjacent to and over the rigid surface. The user then rotates handle 56 so that foot 52 and bracket ridge 20 come into contact with the rigid surface (not shown). The handle 56 is further rotated so that the rigid surface is securely retained between foot 52 and bracket ridge 20. In this manner, the portable, musical instrument clamp 2 should be securely retained onto the rigid surface.

Universal Musical Instrument Tool

With respect to universal instrument tool 100, preferably, universal musical instrument tool 100 is any suitable musical instrument tool that can be used for repairing and working on musical instruments such as necked/stringed instruments like guitars, basses, cellos, banjos, ukuleles, lutes, violins, mandolins, and the like (not shown). An important aspect of the universal musical instrument tool 100 being that the universal musical instrument tool 100 should be sized and shaped so as to adequately fit within opening 6 and also be able to hold the desired tools and materials needed to work on the musical instrument that is being retained by the portable, musical instrument clamp 2.

Hook Assembly

Regarding hook assembly 150, hook assembly 150 includes, in part, hook arms 152, hook or instrument retaining area 154, hook bracket 156, hook covering 158, and hook extension 160. Preferably, hook arms 152, hook bracket 156, and hook extension 160 are constructed of any suitable, durable, high strength, light weight, rust resistant, UV resistant, rigid material. Also, hook covering 158, preferably, is constructed on any suitable, durable, light weight, rust resistant, UV resistant, flexible material. An important aspect of hook covering 158 is that hook covering 158 should be constructed of a padded or elastomeric material that does not scratch or otherwise damage the musical instrument being retained by portable, musical instrument clamp 2. Furthermore, hook covering 158 should be constructed so that hook covering 158 can withstand having a musical instrument being placed onto hook retaining area 154 multiple times without hook covering 158 wearing out and/or damaging the musical instrument.

As shown in FIGS. 2 and 3, hook extension 160 is used to retain hook assembly 150 within the opening 14 of bracket assembly 3. It is to be understood that hook extension 160 can be removably retained within opening 14 by conventional fastening techniques such as threaded fasteners or the like (not shown).

Figure 4:
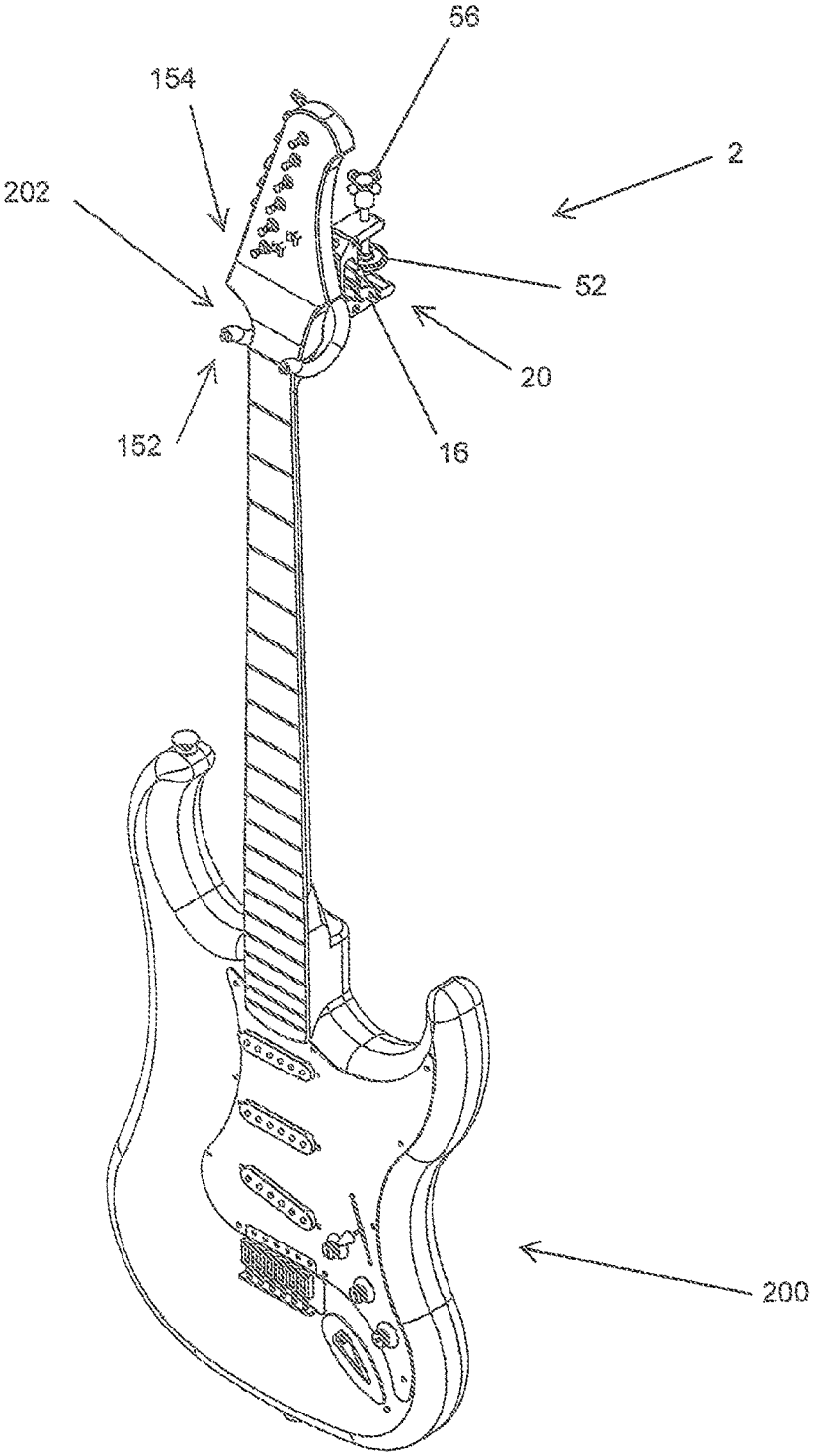
FIG. 4 is a schematic, isometric view of the portable, musical instrument clamp with the musical instrument attached to the clamp, constructed according the present invention.

A unique aspect of the present invention is that different sizes and styles of hook arms 152 can be employed as part of hook assembly 150. In this manner, hook arms 152 that are larger and thicker can be utilized with musical instruments having larger or thicker necks. Furthermore, the curvature of hook retaining area 154 can also be adjusted to account for the size and shape of the musical instrument neck. In particular, the hook retaining area 154 can be made wider and/or deeper so that of hook retaining area 154 is able to adequately retain the neck of a larger musical instrument 200 (FIG. 4).

Another unique aspect of the present invention is that hook assembly 150 can be easily removed from bracket assembly 3. In this manner, if the user desires to use the portable, musical instrument clamp 2 on a different style of musical instrument, the hook extension 160 can be removed from bracket assembly 3 and another hook assembly 150 that more adequately fits the new musical instrument can then be attached to bracket assembly 150, as discussed earlier.

Construction of Portable, Musical Instrument Clamp

In order to construct portable, musical instrument clamp 2, attention is directed to FIGS. 1-3. Initially, the clamp assembly 50 is attached to opening 10 of bracket assembly 3, as discussed earlier. Next, the hook assembly 150 is securely attached to opening 14 of bracket assembly 3, as discussed earlier. Finally, universal musical instrument tool 100 is located within opening 6 of bracket assembly 3, as discussed earlier.

Using Portable, Musical Instrument Clamp

In order to use portable, musical instrument clamp 2, attention is directed to FIGS. 1-4. Initially, the user determines the type of musical instrument 200 that the user wants to use the portable, musical instrument clamp 2 on. Once the user has determined the type of musical instrument 200 that is going to be retained by portable, musical instrument clamp 2, the user may then have to determine the size of hook arms 152 and hook retaining area 154 that will be needed to adequately retain the musical instrument on hook assembly 150. As discussed earlier, there may be several different versions of the hook assembly 150 with each of the different hook assemblies 150 having different sizes and shapes of hook arms 152 and hook retaining area 154. In this way, the portable, musical instrument clamp 2 can be used to accommodate a variety of different sizes and shapes of musical instruments 200.

After the size and shape of the hook assembly 150 has been determined, the desired hook assembly 150 is securely attached to bracket assembly 3, as discussed earlier.

Once the hook assembly 150 has been attached to the bracket assembly 3, the portable, musical instrument clamp 2 is attached to the rigid surface such a chair back, a table, a countertop, a book shelf, a railing or the like, as discussed earlier.

Finally, as shown in FIG. 4, the musical instrument 200 is retained by the portable, musical instrument clamp 2. In particular, the neck area 202 of the musical instrument 200 is retained on the hook arms 152 at the hook retaining area 154. It is to be understood that a variety of musical instruments 200 can be easily and quickly retained on portable, musical instrument clamp 2. The important aspect being that the musical instrument 200 should be constructed such that a portion (usually the neck area 202) of the musical instrument is capable of being properly retained by the hook arms 152 at the hook retaining area 154.

Another unique aspect of the present invention is that the use of clamp assembly 50 allows the portable, musical instrument clamp 2 to be moved to different locations and still allow the portable, musical instrument clamp 2 to properly retain the musical instrument 200 on the portable, musical instrument clamp 2. For example, the user may remove the portable, musical instrument clamp 2 from a rigid location at home where the user normally stores the musical instrument 200. The user may then remove the musical instrument 200 from its normal location, remove the portable, musical instrument clamp 2 from the rigid surface, and place the musical instrument 200 and the portable, musical instrument clamp 2 in a carrying case (not shown) for the musical instrument 200. When the user arrives at the desired destination, the user can then unload the musical instrument 200 and the portable, musical instrument clamp 2, secure the portable, musical instrument clamp 2 to a new rigid location at a desired location, and place the musical instrument 200 (usually at the neck area 202) on the hook arms 152 at the hook retaining area 154 so the musical instrument 200 is again securely retained on the portable, musical instrument clamp 2.

Figure 5:
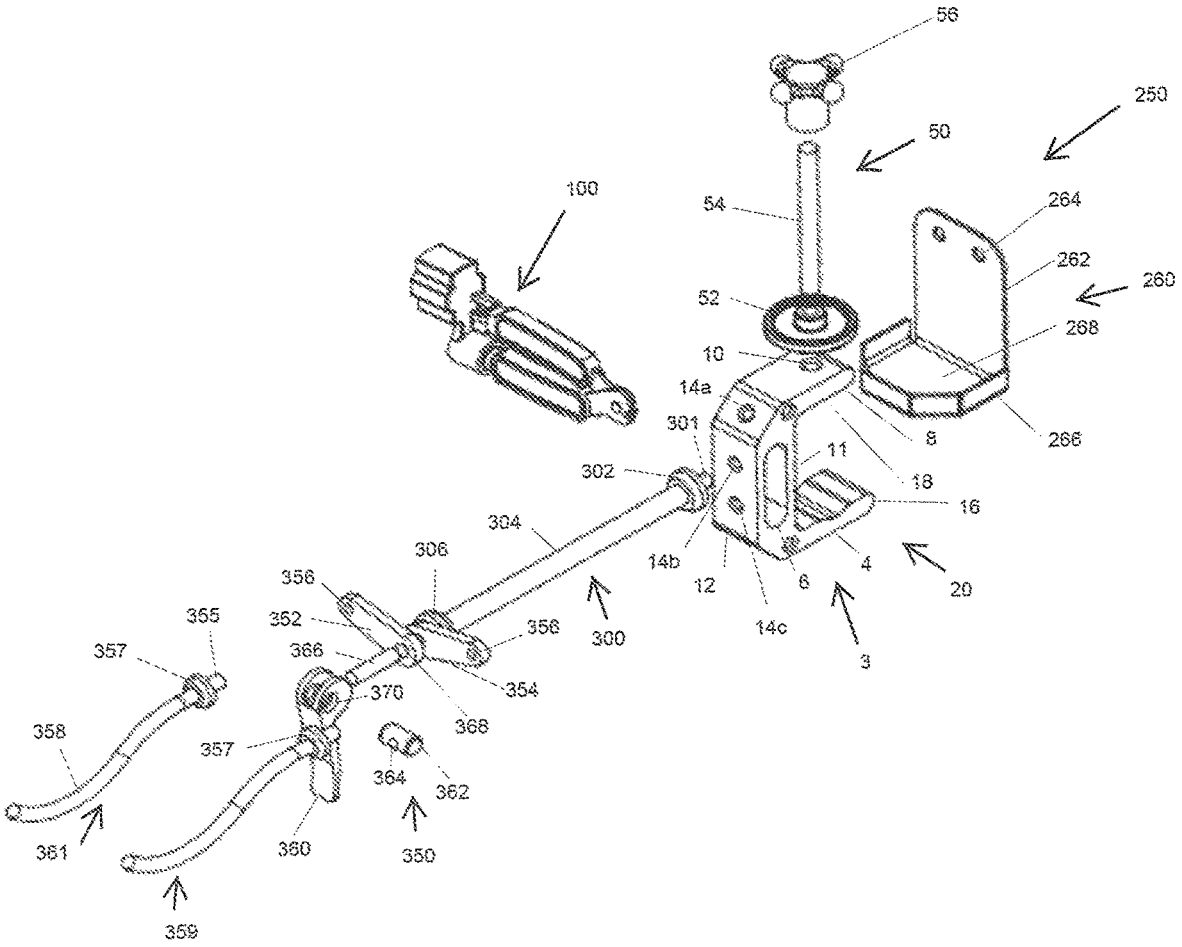
FIG. 5 is a schematic, isometric, exploded view of another embodiment of a portable, musical instrument clamp, constructed according the present invention.
Figure 6:
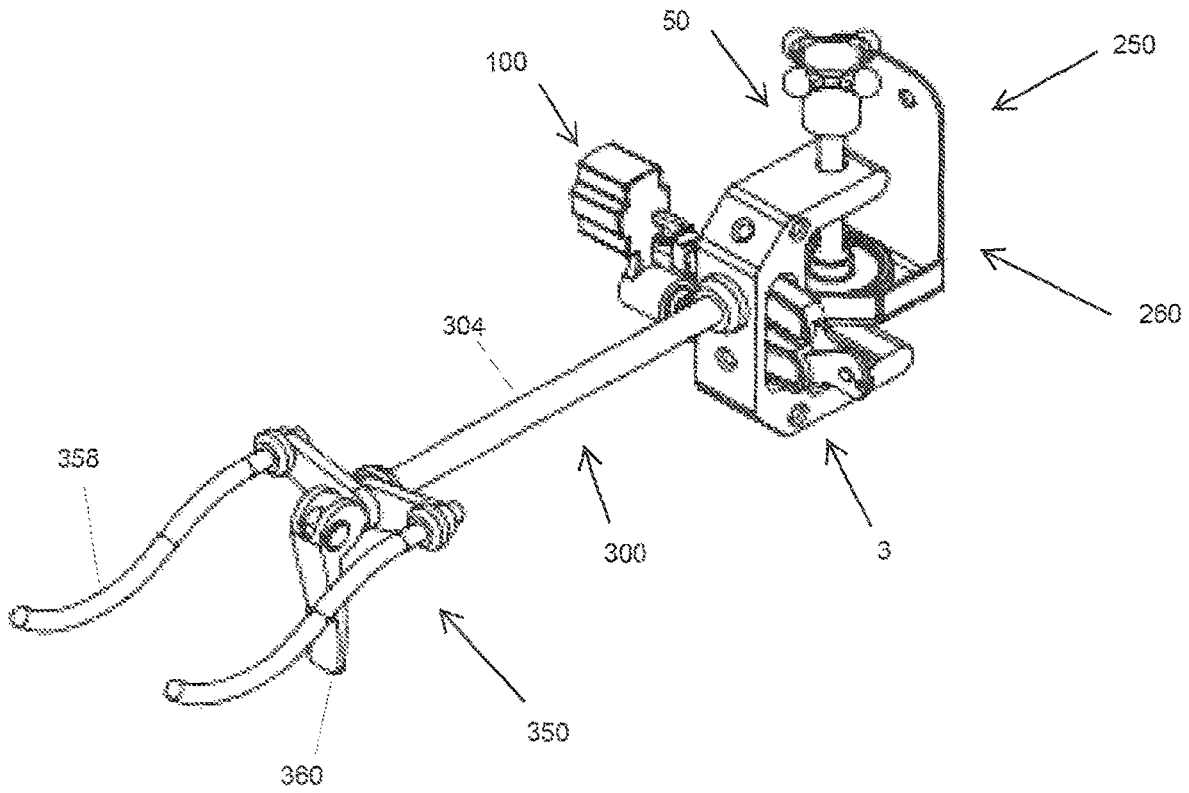
FIG. 6 is a schematic, isometric view of the another embodiment of a portable, musical instrument clamp along with an articulated hook and wall mount, constructed according the present invention.
Figure 7:
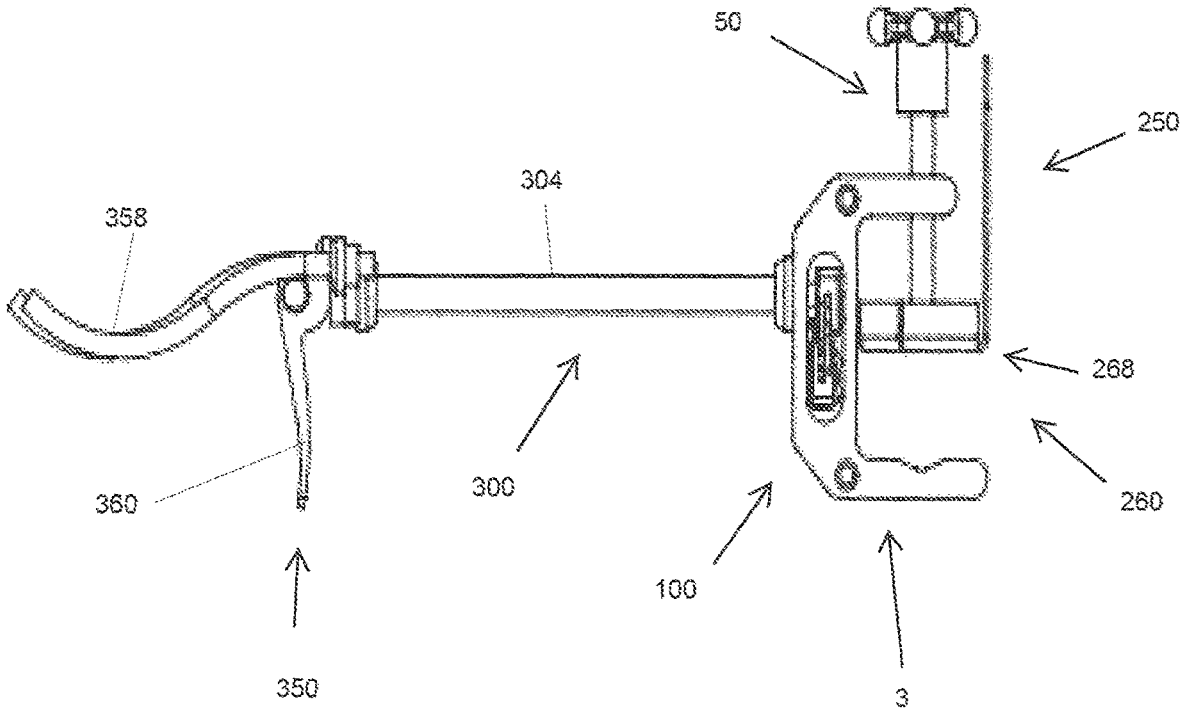
FIG. 7 is a side view of the another embodiment of a portable, musical instrument clamp, constructed according the present invention.

Reference is made now to FIGS. 5-7, where there are illustrated another embodiment of a portable, musical instrument clamp 250. Portable, musical instrument clamp 250 includes, in part, bracket assembly 3, clamp assembly 50, universal musical instrument tool 100, cradle assembly 260, extension assembly 300, and hook assembly 350. It is to be understood that bracket assembly 3, clamp assembly 50, and universal musical instrument tool 100 are substantially similar to the bracket assembly 3, clamp assembly 50, and universal musical instrument tool 100 discussed above. It is to be further understood that musical instrument clamp 250 can also be used to removably retain or hold a variety of other types of devices or equipment besides musical instruments.

Bracket Assembly

As discussed above, bracket assembly 3 includes, in part, bracket face 4, bracket opening 6, bracket face 8 having bracket opening 10, bracket base 11, bracket face 12, bracket openings 14*a*, 14*b*, and 14*c*, bracket extension 16, bracket extension 18, and bracket ridge 20. Preferably, bracket base 11, bracket extension 16, and bracket extension 18 are formed as one single piece by conventional forming techniques such as molding, casting, pressing, printing, or the like. Also, bracket base 11, bracket extension 16, and bracket extension 18 are, preferably, constructed of any suitable, durable, high strength, light weight, rust resistant, UV resistant, rigid material.

It is to be understood that bracket face 4 is to be located along a side of bracket extension 16. Also, bracket face 12 is to be located along a side of bracket base 11. Finally, bracket face 8 is to be located along a side of bracket extension 18.

With respect to bracket opening 6, bracket opening 6, preferably, is formed along bracket base 11 as part of the construction of the single piece construction of bracket base 11, bracket extension 16, and bracket extension 18, as previously described. It is to be understood that an important aspect of bracket opening 6 is that the bracket opening 6 should be sized and shaped so as to securely retain universal musical instrument tool 100, as discussed earlier.

Regarding bracket opening 10 and bracket openings 14*a*-14*c*, bracket opening 10 and bracket openings 14*a*-14*c* are preferably formed by conventional opening forming techniques such as drilling, boring, punching, threading or the like. It is to be understood that an important aspect of bracket opening 10 and bracket openings 14*a*-14*c* is that these openings should be sized and shaped so as to properly retain clamp assembly 50 and extension assembly 300, respectively, as will be described in greater detail later.

With respect to bracket ridge 20, bracket ridge 20 is conventionally formed along one end of bracket extension 16 by conventional forming techniques such as milling, welding, casting, printing, or the like. It is to be understood that an important aspect of the bracket ridge 20 is that it should be sized and shaped to as to be able to interact with clamp assembly 50 in order to securely retain portable, musical instrument clamp 250 on a rigid surface such as cradle assembly 260, a chair back, a table, a countertop, a book shelf, a railing or the like (not shown), as will be discussed in greater detail later.

Clamp Assembly

As discussed above, clamp assembly 50 includes, in part, foot 52, screw 54, and handle 56. Preferably, foot 52, screw 54, and handle 56 are constructed of any suitable, durable, high strength, light weight, rust resistant, UV resistant, rigid material.

It is to be understood that during the construction of clamp assembly 50, screw 54 is conventionally threaded through opening 10. It is to be further understood that opening 10 includes conventional threads (not shown) that will interact with screw 54. Foot 52 is conventionally attached onto one end of screw 54 (FIGS. 6 and 7). Handle 56 is then conventionally attached to the other end of screw 54 (FIGS. 6 and 7).

As will be discussed in greater detail later, in order to secure portable, musical instrument clamp 250 onto a rigid surface such as cradle assembly 260, a chair back, a table, a countertop, a book shelf, a railing or the like (not shown), the user locates portable, musical instrument clamp 250 so that clamp assembly 50 is located adjacent to and over the cradle assembly 260 or the rigid surface. The user then rotates handle 56 so that foot 52 and bracket ridge 20 come into contact with the cradle assembly 260 or the rigid surface (not shown). The handle 56 is further rotated so that the cradle assembly 260 or the rigid surface is securely retained between foot 52 and bracket ridge 20. In this manner, the portable, musical instrument clamp 250 should be securely retained onto the cradle assembly 260 or the rigid surface.

Cradle Assembly

As shown in FIGS. 5-7, cradle assembly 260, includes, in part, wall plate 262, openings 264, bottom plate sides 266, and bottom plate 268. Preferably, wall plate 262, bottom plate sides 266, and bottom plate 268 are constructed of any suitable, durable, high strength, light weight, rust resistant, UV resistant, rigid material. Also, wall plate 262 is conventionally attached to bottom plate 268 by conventional techniques such as welding, soldering, adhesives or the like. Finally, bottom plate sides 266 are conventionally attached to bottom plate 268 by conventional techniques such as welding, soldering, adhesives or the like. It is to be understood that openings 264 can be used to conventionally secure cradle assembly 260 to a rigid surface such as a wall or the like (not shown) through the use of conventional fasteners or the like (not shown).

A unique aspect of the present invention is the use of cradle assembly 260. In particular, as shown in FIGS. 6 and 7, in order to secure portable, musical instrument clamp 250 onto a rigid surface such as cradle assembly 260, once the cradle assembly 260 has been conventionally secured to a rigid surface such as a wall (not shown), the user locates portable, musical instrument clamp 250 so that clamp assembly 50 is located adjacent to and over the cradle assembly 260. The user then rotates handle 56 so that foot 52 and bracket ridge 20 come into contact with the sides of bottom plate 268. The handle 56 is further rotated so that the bottom plate 268 is securely retained between foot 52 and bracket ridge 20. In this manner, the portable, musical instrument clamp 250 should be securely retained onto the cradle assembly 260.

Universal Musical Instrument Tool

As discussed above, universal musical instrument tool 100 is any suitable musical instrument tool that can be used for repairing and working on musical instruments such as necked/stringed instruments 200 (FIG. 8) like guitars, basses, cellos, banjos, ukuleles, lutes, violins, mandolins, and the like. An important aspect of the universal musical instrument tool 100 being that the universal musical instrument tool 100 should be sized and shaped so as to adequately fit within opening 6 and also be able to hold the desired tools and materials needed to work on the musical instrument that is being retained by the portable, musical instrument clamp 250.

Extension Assembly

As shown in FIGS. 5-7, extension assembly 300, includes, in part, extension end 301, extension connector 302, extension rod 304, and extension connector 306. Preferably, extension end 301, extension connector 302, extension rod 304, and extension connector 306 are constructed of any suitable, durable, high strength, light weight, rust resistant, UV resistant, rigid material. Extension connector 302 is conventionally attached to the end of extension rod 304 adjacent to extension end 301 by conventional techniques such as welding, soldering, adhesives or the like. Extension connector 306 is conventionally attached to the other end of extension rod 304 by conventional techniques such as welding, soldering, adhesives or the like.

Figure 8:
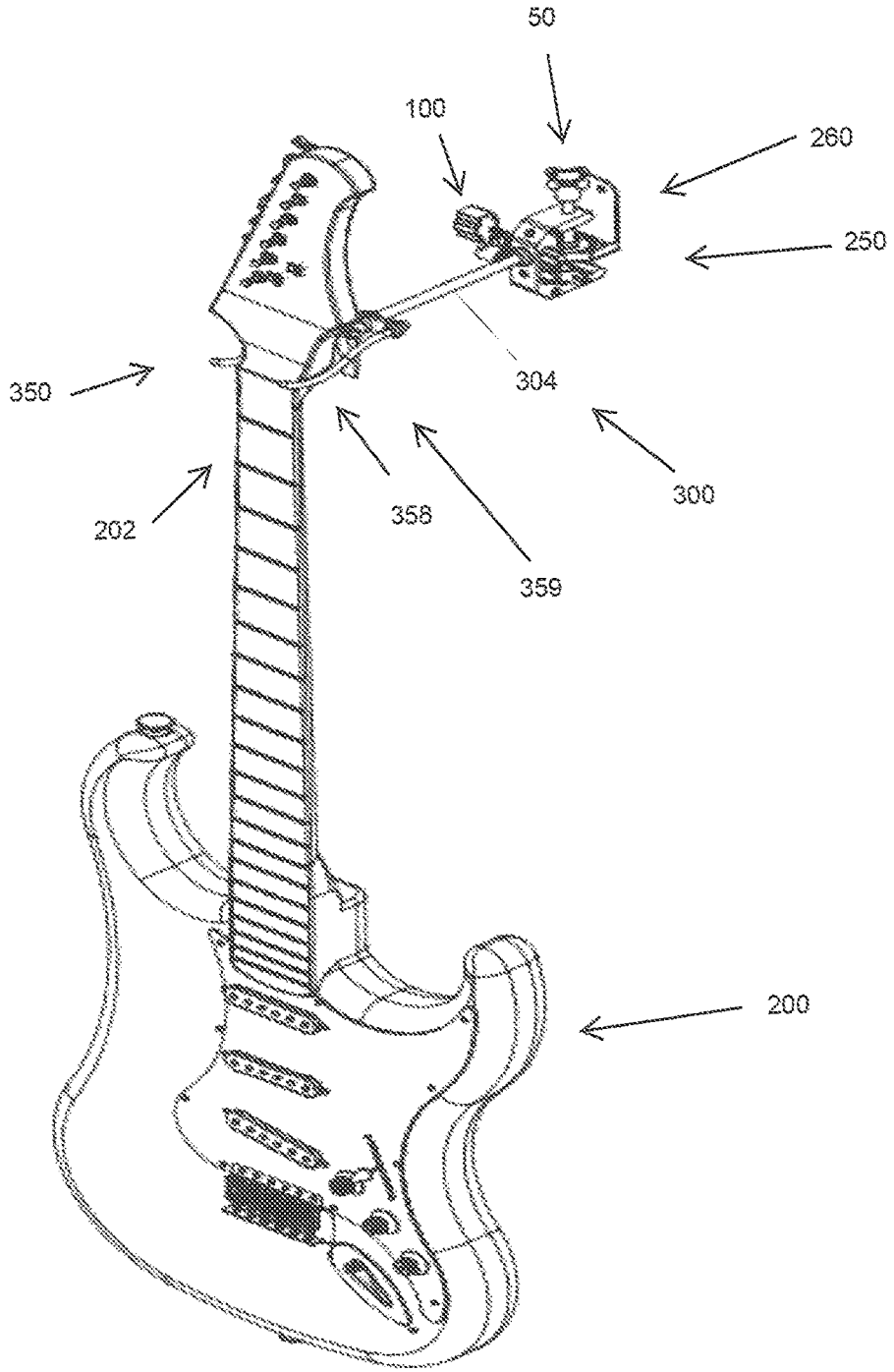
FIG. 8 is a schematic, isometric view of the another embodiment of a portable, musical instrument clamp with the musical instrument attached to the clamp, constructed according the present invention.

Another unique aspect of the present invention is the use of extension assembly 300. In particular, extension rod 304 can vary in length to accommodate different applications such as the holding of different sized musical instruments 200 (FIG. 8). The extension rod 304 can be removed and re-attached to the clamp assembly 50 in any of the available threaded openings 14*a*-14*c*. In this manner the portable, musical instrument clamp 250 allows the instrument 200 to hang and position the instrument 200 at different angles.

Hook Assembly

Regarding hook assembly 350, hook assembly 350 includes, in part, articulating arms 352 and 354, hook arm ends 355, openings 356, hook arm connectors 357, hook arms 358, hook retaining area 359, hook lock arm 360, hook covering 361, hook lock connector 362, opening 364, hook lock extension 366, articulating arm openings 368, and hook lock openings 370. Preferably, articulating arms 352 and 354, hook arm ends 355, hook arm connector 357, hook arms 358, hook lock arm 360, hook lock connector 362, and hook lock extension 366 are constructed of any suitable, durable, high strength, light weight, rust resistant, UV resistant, rigid material. Also, hook covering 361, preferably, is constructed on any suitable, durable, light weight, rust resistant, UV resistant, flexible material. An important aspect of hook covering 361 is that hook covering 361 should be constructed of a material that does not scratch or otherwise damage the musical instrument 200 being retained by portable, musical instrument clamp 250. Furthermore, hook covering 361 should be constructed so that hook covering 361 can withstand having a musical instrument 200 being placed onto hook retaining area 359 multiple times without hook covering 361 wearing out and/or damaging the musical instrument.

Another unique aspect of the present invention is hook assembly 350. As shown in FIGS. 6 and 7, articulating arms 352 and 354 are constructed to attach to extension connector 306 through the use of hook lock extension 366 and opening 364. In particular, one end of hook lock extension 366 is located through articulating arm openings 368. It is to be understood that each of the articulating arms 352 and 354 have an articulating arm opening 368. Furthermore, it is to be understood that the one end of hook lock extension 366 is also conventionally threaded so that this end can be removably secured into extension connector 306. In this manner, the orientation of the articulating arms 352 and 354 can be adjusted, as will be described in greater detail later.

A still another unique aspect of the present invention is the use of hook lock arm 360, hook lock connector 362, opening 364, hook lock extension 366, and hook lock openings 370. As shown in FIGS. 6-8, the hook lock connector 362 is conventionally threaded so that it can be securely attached to the other end of hook lock extension 366. It is to be understood that hook lock connector 362 is located within the openings 370 of hook lock arm 360. Furthermore, the other end of hook lock extension 366 is conventionally threaded so that this end can be secured onto hook lock connector 362. In this manner, hook arm lock 360 can be used to secure the orientation of articulating arms 352 and 354 by manipulating (i.e., rotating) hook lock arm 360 around hook lock connector 362 so that hook lock arm 360 creates pressure (tension) on articulating arms 352 and 354 against extension connector 306 in order to retain articulating arms 352 and 354 in place against extension connector 306. In this manner, the orientation of articulating arms 352 and 354 can be adjusted to accommodate varying sizes of instruments 200 and their respective head stocks, necks or shapes.

As shown in FIGS. 6-8, hook arm ends 355 and hook arm connectors 357 are used to retain hook arms 358 within the opening 356 of articulating arms 352 and 354. It is to be understood that hook arm ends 355 can be conventionally threaded so that hook arm ends can be removably retained within openings 356. It is to be understood that openings 356 can also be conventionally threaded so as to be able to properly retain hook arm ends 355.

A unique aspect of the present invention is that different sizes and styles of hook arms 358 can be employed as part of hook assembly 350. In this manner, hook arms 358 that are larger and thicker can be utilized with musical instruments 200 having larger or thicker necks. Furthermore, the curvature of hook retaining area 359 can also be adjusted to account for the size and shape of the musical instrument neck. In particular, the hook retaining area 359 can be made wider and/or deeper so that of hook retaining area 359 is able to adequately retain the neck of a larger musical instrument 200. The user merely has to remove hook arms 358 from openings 356 and removably secure a different set to hook arms 358 onto openings 356.

Construction of Portable, Musical Instrument Clamp

In order to construct portable, musical instrument clamp 250, attention is directed to FIGS. 5-8. Initially, the clamp assembly 50 is attached to opening 10 of bracket assembly 3, as discussed earlier. Next, the extension assembly 300 is securely attached to one of the openings 14*a*-14*c* of bracket assembly 3, as discussed earlier. The hook assembly 350 is attached to extension assembly 300. Finally, universal musical instrument tool 100 is located within opening 6 of bracket assembly 3, as discussed earlier.

Using Portable, Musical Instrument Clamp

In order to use portable, musical instrument clamp 250, attention is directed to FIGS. 5-8. Initially, the user determines the type of musical instrument 200 or other suitable device that the user wants to use the portable, musical instrument clamp 250 on. Once the user has determined the type of musical instrument 200 that is going to be retained by portable, musical instrument clamp 250, the user may then have to determine the size of hook arms 358 and hook retaining area 359 that will be needed to adequately retain the musical instrument or other suitable device on hook assembly 350. As discussed earlier, there may be several different versions of the hook assembly 350 with each of the different hook assemblies 350 having different sizes and shapes of hook arms 358 and hook retaining area 359. In this way, the portable, musical instrument clamp 250 can be used to accommodate a variety of different sizes and shapes of musical instruments or other suitable devices.

After the size and shape of the hook assembly 350 has been determined, the desired hook assembly 350 is removably, securely attached to extension assembly 300, as discussed earlier.

Once the hook assembly 350 has been attached to the extension assembly 300, the orientation of hook arms 358 can be adjusted through the use of articulating arms 352, as discussed earlier. After the orientation of hook arms 358 have been adjusted, the portable, musical instrument clamp 250 is attached to the rigid surface such cradle assembly 260 or a chair back, a table, a countertop, a book shelf, a railing (not shown) or the like, as discussed earlier.

Finally, as shown in FIG. 8, the musical instrument 200 is retained by the portable, musical instrument clamp 250. In particular, the neck area 202 of the musical instrument 200 is retained on the hook arms 358 at the hook retaining area 359. It is to be understood that a variety of musical instruments 200 can be easily and quickly retained on portable, musical instrument clamp 250. The important aspect being that the musical instrument 200 should be constructed such that a portion (usually the neck area 202) of the musical instrument is capable of being properly retained by the hook arms 358 at the hook retaining area 359.

Another unique aspect of the present invention is that the use of clamp assembly 50 allows the portable, musical instrument clamp 250 to be moved to different locations and still allow the portable, musical instrument clamp 250 to properly retain the musical instrument 200 on the portable, musical instrument clamp 250. For example, the user may remove the portable, musical instrument clamp 250 from a rigid location at home where the user normally stores the musical instrument 200. The user may then remove the musical instrument 200 from its normal location, remove the portable, musical instrument clamp 250 from the rigid surface, and place the musical instrument 200 and the portable, musical instrument clamp 250 in a carrying case for the musical instrument. When the user arrives at the desired destination, the user can then unload the musical instrument 200 and the portable, musical instrument clamp 250, secure the portable, musical instrument clamp 250 to a new rigid location at the desired location, and place the musical instrument 200 (usually at the neck area 202) on the hook arms 358 at the hook retaining area 359 so the musical instrument 200 is again securely retained on the portable, musical instrument clamp 250.

The preceding merely illustrates the principles of the invention. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

This description of the exemplary embodiments is intended to be read in connection with the figures of the accompanying drawing, which are to be considered part of the entire written description. In the description, relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

All patents, publications, scientific articles, web sites, and other documents and materials referenced or mentioned herein are indicative of the levels of skill of those skilled in the art to which the invention pertains, and each such referenced document and material is hereby incorporated by reference to the same extent as if it had been incorporated by reference in its entirety individually or set forth herein in its entirety.

The applicant reserves the right to physically incorporate into this specification any and all materials and information from any such patents, publications, scientific articles, web sites, electronically available information, and other referenced materials or documents to the extent such incorporated materials and information are not inconsistent with the description herein.

All of the features disclosed in this specification may be combined in any combination. Thus, unless expressly stated otherwise, each feature disclosed is only an example of a generic series of equivalent or similar features.

The specific methods and compositions described herein are representative of preferred embodiments and are exemplary and not intended as limitations on the scope of the invention. Other objects, aspects, and embodiments will occur to those skilled in the art upon consideration of this specification and are encompassed within the spirit of the invention. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, the terms "comprising", "including", "containing", etc. are to be read expansively and without limitation. The methods and processes illustratively described herein suitably may be practiced in differing orders of steps, and that they are not necessarily restricted to the orders of steps indicated herein.

The terms and expressions that have been employed are used as terms of description and not of limitation, and there is no intent in the use of such terms and expressions to exclude any equivalent of the features shown and described or portions thereof, but it is recognized that various modifications are possible within the scope of the invention. Thus, it will be understood that although the present invention has been specifically disclosed by various embodiments and/or preferred embodiments and optional features, any and all modifications and variations of the concepts herein disclosed that may be resorted to by those skilled in the art are considered to be within the scope of this invention.

The invention has been described broadly and generically herein. Each of the narrower species and sub-generic groupings falling within the generic disclosure also form part of the invention. This includes the generic description of the invention with a proviso or negative limitation removing any subject matter from the genus, regardless of whether or not the excised material is specifically recited herein.

Other modifications and implementations will occur to those skilled in the art without departing from the spirit and the scope of the invention. Accordingly, the description hereinabove is not intended to limit the invention.

Therefore, provided herein is a new and improved portable, musical instrument clamp, which according to various embodiments of the present invention, offers the following advantages: ease of use; portability; the ability to securely retain a musical instrument or other suitable device; the ability to be stored in the musical instrument carrying case; the ability to retain a variety of musical instruments or other suitable devices; the ability to be securely attached to a variety of rigid surfaces; lightness in weight; reduced cost; and the ability retain a universal musical instrument tool to be used for repairing and working on the musical instruments.

In fact, in many of the preferred embodiments, these advantages of ease of use; portability; the ability to securely retain a musical instrument or other suitable device; the ability to be stored in the musical instrument carrying case; the ability to retain a variety of musical instruments or other suitable devices; the ability to be securely attached to a variety of rigid surfaces; lightness in weight; reduced cost; and the ability retain a universal musical instrument tool to be used for repairing and working on the musical instruments are optimized to an extent that is considerably higher than heretofore achieved in prior, known musical instrument stands and musical instrument holders/hangers.

I claim:

1. A musical instrument clamp system, comprising:

a bracket assembly having a first end and a second end;

a cradle assembly;

a clamp assembly operatively connected to the first end of the bracket assembly, wherein the clamp assembly is also removably attached to the cradle assembly;

an extension assembly having a first end and a second end, wherein the first end of the extension assembly is operatively connected to the second end of the bracket assembly;

a hook assembly, wherein the hook assembly is operatively connected to the second end of the extension assembly; and a musical instrument removably retained on the hook assembly.

2. The musical instrument clamp system, according to claim 1, wherein the bracket assembly is further comprised of:

a first bracket face;

a first bracket opening located on the first bracket face;

a bracket base operatively connected to the first bracket face;

a bracket base opening located on the bracket base;

a second bracket face operatively connected to the bracket base;

a plurality of second bracket openings located along the bracket base;

a first bracket extension located at an end of the first bracket face;

a second bracket extension located at an end of the second bracket face; and a bracket ridge located along the second bracket extension.

3. The musical instrument clamp system, according to claim 2, wherein the musical instrument clamp is further comprised of:

a musical instrument tool removably retained within the bracket base opening in the bracket assembly.

4. The musical instrument clamp system, according to claim 1, wherein the cradle assembly is further comprised of:

a wall plate having a plurality of openings located along one end of the wall plate;

a bottom plate operatively connected to the other end of the wall plate; and a plurality of bottom plate sides operatively connected to a periphery of the bottom plate.

5. The musical instrument clamp system, according to claim 1, wherein the extension assembly is further comprised of:

an extension rod having a first end and a second end;

a first extension connector operatively connected to the first end of the extension rod; and a second extension connector operatively connected to the second end of the extension rod.

6. The musical instrument clamp system, according to claim 5, wherein the hook assembly is further comprised of:

a plurality of articulating arms, wherein each of the plurality of articulating arms includes a first and a second opening;

a plurality of hook arms, wherein each of the plurality of hook arms includes a first end and a second end such that the first end of the each of plurality of hook arms is removably attached to a first opening in one of the plurality of articulating arms;

a plurality of hook arm connectors, wherein each of the plurality of hook arm connectors is located adjacent to the first end of the each of plurality of hook arms;

a hook retaining area located adjacent to the second end of each of the plurality of hook arms; and a hook covering located adjacent to the second end of each of the plurality of hook arms.

7. The musical instrument clamp system, according to claim 6, wherein the hook assembly is further comprised of:

a hook lock extension having a first end and a second end such that the first end of the hook lock extension is removably connected to the second opening in each of the plurality of articulating arms and the second extension connector;

a hook lock connector operatively connected to the second end of the hook lock extension; and a hook lock arm rotatably connected to the hook lock connector.

8. A device for removably retaining a piece of equipment, comprising:

a bracket assembly having a first end and a second end;

a cradle assembly;

a clamp assembly operatively connected to the first end of the bracket assembly, wherein the clamp assembly is removably attached to the cradle assembly;

an extension assembly having a first end and a second end, wherein the first end of the extension assembly is operatively connected to the second end of the bracket assembly;

a hook assembly, wherein the hook assembly is operatively connected to the second end of the extension assembly; and a piece of equipment removably retained on the hook assembly.

9. The device, according to claim 8, wherein the bracket assembly is further comprised of:

a first bracket face;

a first bracket opening located on the first bracket face;

a bracket base operatively connected to the first bracket face;

a bracket base opening located on the bracket base;

a second bracket face operatively connected to the bracket base;

a plurality of second bracket openings located along the bracket base;

a first bracket extension located at an end of the first bracket face;

a second bracket extension located at an end of the second bracket face; and a bracket ridge located along the second bracket extension.

10. The device, according to claim 9, wherein the device is further comprised of:

a tool removably retained within the bracket base opening in the bracket assembly.

11. The device, according to claim 8, wherein the cradle assembly is further comprised of:

a wall plate having a plurality of openings located along one end of the wall plate;

a bottom plate operatively connected to the other end of the wall plate; and a plurality of bottom plate sides operatively connected to a periphery of the bottom plate.

12. The device, according to claim 8, wherein the extension assembly is further comprised of:

an extension rod having a first end and a second end;

a first extension connector operatively connected to the first end of the extension rod; and a second extension connector operatively connected to the second end of the extension rod.

13. The device, according to claim 12, wherein the hook assembly is further comprised of:

a plurality of articulating arms, wherein each of the plurality of articulating arms includes a first and a second opening;

a plurality of hook arms, wherein each of the plurality of hook arms includes a first end and a second end such that the first end of the each of plurality of hook arms is removably attached to a first opening in one of the plurality of articulating arms;

a plurality of hook arm connectors, wherein each of the plurality of hook arm connectors is located adjacent to the first end of the each of plurality of hook arms;

a hook retaining area located adjacent to the second end of each of the plurality of hook arms; and a hook covering located adjacent to the second end of each of the plurality of hook arms.

14. The device, according to claim 13, wherein the hook assembly is further comprised of:

a hook lock extension having a first end and a second end such that the first end of the hook lock extension is removably connected to the second opening in each of the plurality of articulating arms and the second extension connector;

a hook lock connector operatively connected to the second end of the hook lock extension; and a hook lock arm rotatably connected to the hook lock connector.

15. A method of constructing a musical instrument clamp system, comprising:

providing a bracket assembly having a first end and a second end;

providing a cradle assembly;

attaching a clamp assembly to the first end of the bracket assembly;

removably attaching the clamp assembly to the cradle assembly;

removably attaching a first end of an extension assembly to the second end of the bracket assembly;

removably attaching a hook assembly to a second end of the extension assembly; and removably retaining a musical instrument on the hook assembly.

16. The method, according to claim 15, wherein the method is further comprised of:

removably retaining a musical instrument tool within an opening in the bracket assembly.

17. The method, according to claim 15, wherein the providing a cradle assembly is further comprised of:

providing a wall plate having a plurality of openings located along one end of the wall plate;

attaching a bottom plate to the other end of the wall plate; and attaching a plurality of bottom plate sides to a periphery of the bottom plate.

18. The method, according to claim 15, wherein the extension assembly is further comprised of:

providing an extension rod having a first end and a second end;

attaching a first extension connector to the first end of the extension rod; and attaching a second extension to the second end of the extension rod.

19. The method, according to claim 18, wherein the hook assembly is further comprised of:

providing a plurality of articulating arms, wherein each of the plurality of articulating arms includes a first and a second opening;

providing a plurality of hook arms, wherein each of the plurality of hook arms includes a first end and a second end such that the first end of the each of plurality of hook arms is removably attached to a first opening in one of the plurality of articulating arms;

providing a plurality of hook arm connectors, wherein each of the plurality of hook arm connectors is located adjacent to the first end of the each of plurality of hook arms;

providing a hook retaining area that is located adjacent to the second end of each of the plurality of hook arms; and providing a hook covering that is located adjacent to the second end of each of the plurality of hook arms.

20. The method, according to claim 19, wherein the hook assembly is further comprised of:

providing a hook lock extension having a first end and a second end such that the first end of the hook lock extension is removably connected to the second opening in each of the plurality of articulating arms and the second extension connector;

attaching a hook lock connector to the second end of the hook lock extension; and attaching a hook lock arm to the hook lock connector such that the hook lock arm is rotatably connected to the hook lock connector.

* * * * *